US010759551B2

(12) United States Patent
Hirt et al.

(10) Patent No.: US 10,759,551 B2
(45) Date of Patent: Sep. 1, 2020

(54) EJECTION HEAD FOR AN EJECTION DEVICE OF A SEALING MACHINE FOR SEALING A CONTAINER

(71) Applicant: Ferrum AG, Schafisheim (CH)

(72) Inventors: Pascal Hirt, Dürrenäsch (CH); Theo Thalmann, St. Gallen (CH)

(73) Assignee: FERRUM AG, Schafisheim (CH)

( * ) Notice: Subject to any disclaimer, the term of this patent is extended or adjusted under 35 U.S.C. 154(b) by 166 days.

(21) Appl. No.: 15/860,953

(22) Filed: Jan. 3, 2018

(65) Prior Publication Data

US 2018/0201397 A1 Jul. 19, 2018

(30) Foreign Application Priority Data

Jan. 17, 2017 (EP) ..... 17151734

(51) Int. Cl.

| | |
|---|---|
| ***B67B 3/10*** | (2006.01) |
| ***B65B 7/28*** | (2006.01) |
| ***B67B 3/20*** | (2006.01) |
| ***B67B 3/26*** | (2006.01) |

(52) U.S. Cl.

CPC ..... *B65B 7/2842* (2013.01); *B67B 3/10* (2013.01); *B67B 3/2066* (2013.01); *B67B 3/268* (2013.01); *B67B 3/2013* (2013.01)

(58) Field of Classification Search

CPC ..... B67B 3/00; B67B 3/10; B67B 3/2013; B67B 3/268; B67B 3/20; B67B 3/2053; B67B 3/261; B67B 3/264; B65B 7/2835

USPC ..... 53/485

See application file for complete search history.

(56) References Cited

U.S. PATENT DOCUMENTS 2,359,932 A * 10/1944 Newey ..... B67B 1/04 53/201
2,891,366 A * 6/1959 Stover ..... B67B 3/18 53/361
3,572,007 A * 3/1971 Shelby ..... B29C 57/12 53/282

(Continued)

FOREIGN PATENT DOCUMENTS

DE 19859963 A1 7/2000
EP 0367005 A1 5/1990

(Continued)

OTHER PUBLICATIONS

Extended European Search Report dated Jul. 11, 2017 in 17151734.5 Filed Jan. 17, 2017.

*Primary Examiner* — Praachi M Pathak
(74) *Attorney, Agent, or Firm* — Global IP Counselors, LLP

(57) ABSTRACT

An ejection head for an ejection device of a sealing machine for sealing a container includes a supporting element with a supporting axis and a sliding end, and a sliding element for sliding the supporting element along a sliding profile of the sealing machine. The sliding element is arranged at the sliding end and a force acting essentially in the direction of the supporting axis is capable of being transmitted via the sliding element to the supporting element. So that the sliding element and the sliding profile are subject to reduced wear, the sliding element is a rotatable rolling element, so that in the operating state the supporting element is capable of being unrolled over the rotatable rolling element along the sliding profile.

17 Claims, 4 Drawing Sheets

(56) References Cited

U.S. PATENT DOCUMENTS 3,771,283 A * 11/1973 Over ..... B67B 3/12 53/201
3,946,540 A * 3/1976 Solberg ..... B67B 3/10 53/341
4,205,502 A * 6/1980 Ahlers ..... B67B 3/02 53/308
4,696,086 A * 9/1987 Dickerson ..... B21D 53/48 29/243.519
4,733,214 A * 3/1988 Andresen ..... G05G 5/06 324/207.24
5,040,354 A * 8/1991 Ahlers ..... B67B 3/00 53/167
5,058,474 A * 10/1991 Herrera ..... B27B 25/02 144/253.1
5,445,119 A * 8/1995 Regueiro ..... F01L 1/143 123/90.48
6,015,145 A * 1/2000 Hartel ..... B65H 3/0875 270/52.2
6,374,576 B1 * 4/2002 Baini ..... B67B 3/10 53/303
6,679,026 B1 * 1/2004 Cirio ..... B67B 3/2033 53/317
6,871,482 B2 * 3/2005 Cirio ..... B67B 3/2086 53/317
9,174,832 B2 * 11/2015 Shi ..... B67B 3/20
9,296,599 B2 * 3/2016 Forestelli ..... B67B 3/261
9,688,426 B2 * 6/2017 Chauvin ..... B65B 3/022
2007/0084151 A1 * 4/2007 Brown ..... B67B 3/2066 53/490
2007/0125334 A1 * 6/2007 Koerner ..... F01L 1/143 123/90.51
2010/0192514 A1 * 8/2010 Zanini ..... B67B 3/10 53/303
2013/0036708 A1 * 2/2013 Masuda ..... B65B 7/285 53/268
2015/0075936 A1 * 3/2015 Akiyoshi ..... F16D 41/088 192/45.004
2016/0319891 A1 * 11/2016 Saito ..... F16D 27/06
2017/0291269 A1 * 10/2017 Wells ..... B23P 19/02

FOREIGN PATENT DOCUMENTS

EP 1103513 A1 5/2001
EP 1405819 A1 4/2004
WO 2005054113 A1 6/2005

* cited by examiner

--PRIOR ART--

--PRIOR ART--

EJECTION HEAD FOR AN EJECTION DEVICE OF A SEALING MACHINE FOR SEALING A CONTAINER

CROSS-REFERENCE TO RELATED APPLICATION

This application claims priority to European Application No. 17151734.5, filed Jan. 17, 2017, the contents of which are hereby incorporated herein by reference.

BACKGROUND

Field of the Invention

The invention relates to an ejection head for an ejection device of a sealing machine, an ejection device for a sealing machine and a sealing machine for sealing a container.

Background of the Invention

To explain a known ejection head, reference is made below to FIG. 1 and FIG. 2, on the basis of which the prior art will be described in more detail. To distinguish the prior art from the present invention, the reference signs, which refer to features of known examples are provided with an inverted comma, while features of embodiments according to the invention are provided with reference signs which have no inverted comma.

FIG. 1 shows the structure of a known ejection head 1' and FIG. 2 the known ejection head 1' of FIG. 1 in the operating state.

According to FIG. 1, the ejection head 1' comprises a supporting element 2' with a supporting axis 3' and a sliding end 4', and a sliding element 5' for sliding the supporting element 2' along a sliding profile of the sealing machine. The sliding element 5' is arranged at the sliding end 4' and can transmit a force acting essentially in the direction of the supporting axis 3' to the supporting element 2'. In the known ejection head 1', the sliding element 5' has a rounded surface.

In the operating state, the ejection head 1' is connected to an ejection rod. Thereby, the ejection head 1' and the ejection rod form a part of an ejection device. The force can be transmitted to the ejection rod via the supporting element.

FIG. 2 shows the known ejection head 1' in the operating state. Thereby, the ejection head 1' slides with the sliding element 5' along a sliding profile 6' of the sealing machine. In order to achieve the two functions of holding down the container and of ejecting the container, the sliding profile 6' has two sections with an elevated level. Thus, the one section with an elevated level of the sliding profile 6' corresponds to the function of holding down the container, in which the container to be sealed is held for the sealing operation by the ejection device and is centered for the lid sealing. The other section with an elevated level of the sliding profile 6' corresponds to the function of ejecting the container, in which the sealed container is ejected from the sealing machine by the ejection device. During the procedure of holding down the container and of ejecting the container, the ejection head 1' is moved along the sliding profile 6' and can also rotate around its supporting axis 3'. The rounded surface of the sliding element 5' performs a sliding movement along the sliding profile 6'. Thereby, the rounded surface is lubricated by an oil jet (not shown), so that a lubricating film builds up between the rounded surface and the sliding profile 6'.

SUMMARY

An essential disadvantage of the known ejection head is, that the movement performed by it along the sliding profile is basically a sliding movement. This sliding movement leads to increased wear of the sliding profile and the sliding element. Furthermore, there is the risk, that the lubricating film tears off between the sliding profile and the sliding element. Both issues lead to an increased load on the sealing machine due to vibrations, which has a negative effect on the smooth running and the energy consumption of the sealing machine. In particular, as a result of the increased wear, the sliding profile and/or the sliding element must be replaced frequently. Furthermore, the risk of tearing off the lubricating film requires extensive lubrication.

Based on this prior art, it is therefore an object of the invention to propose an ejection head for an ejection device of a sealing machine, an ejection device for a sealing machine and a corresponding sealing machine for sealing a container, all of which involve reduced wear, cause reduced energy consumption, include an improved and simplified lubricity and have increased smooth running.

The objects of the invention meeting this problem are characterized by the features of the embodiments described herein.

Thus, the invention relates to an ejection head for an ejection device of a sealing machine for sealing a container comprising a supporting element with a supporting axis and a sliding end and a sliding element for sliding the supporting element along a sliding profile of the sealing machine, wherein the sliding element is arranged at the sliding end and a force acting essentially in the direction of the supporting axis can be transmitted via the sliding element to the supporting element.

According to the invention, the sliding element is designed as a rotatable rolling element, so that in the operating state the supporting element can be unrolled over the rotatable rolling element along the sliding profile.

That is to say, in the framework of this invention, the sliding element performs a rolling movement at the sliding profile. The sliding element can rotate freely relative to the supporting element in order to perform the rolling movement. This essentially means that the sliding element can rotate around two different axes. On the one hand, it can rotate around the supporting axis. On the other hand, it can also rotate around an axis which is perpendicular to the direction of movement and which varies during the movement of the sliding element at the sliding profile. This is in contrast to the prior art, where the sliding element is rigidly connected to the supporting element and performs a pure sliding movement at the sliding profile.

It is an essential advantage of the ejection head according to the invention that due to the rolling movement of the sliding element at the sliding profile, the wear of the sliding element and the sliding profile is reduced. As a result, the service life of the ejection head and the sliding profile or the change intervals of the ejection head and the sliding profile can be extended. Furthermore, an increased smooth running is achieved by the rolling movement of the sliding element at the sliding profile resulting in a reduced energy consumption of the sealing machine and a decreased load on the sealing machine due to vibrations. In addition, the ejection head according to the invention improves the lubricity of the ejection head and simplifies the lubricating.

In an embodiment, which is very important in practice, the ejection head additionally comprises a bearing element, via which the rotatable rolling element is mounted at the supporting element. Due to the bearing element, the lubrication of the rolling element is simplified, the rolling movement of the rolling element is improved, the wear of the rolling element and the sliding profile is reduced and the heat generation at the rolling element and the sliding profile is decreased. Furthermore, the positioning of the rolling element at the ejection head is improved by the bearing element.

It has proved to be advantageous when the bearing element is detachably connected to the supporting element. As a result, the bearing element can be replaced separately, whereby costs can be reduced at the sealing machine.

It is also advantageous the bearing element and/or the rotatable rolling element having a hardened surface, in particular a hard coating. Hence, the wear of the bearing element and/or the rotatable rolling element can be reduced, which results in an extended service life of the bearing element and/or the rotatable rolling element.

It is also advantageous when the bearing element and/or the rotatable rolling element are made of metal and/or plastic and/or a ceramic material and/or a composite material. This also reduces the wear of the bearing element and/or the rotatable rolling element, which results in an extended service life of the bearing element and/or the rotatable rolling element.

In another embodiment, which can be very important in practice, the ejection head additionally comprises a holding element, via which the rotatable rolling element is held in the bearing element. Due to the holding element, improved securing of the rolling element is achieved at the ejection head. Furthermore, improved lubricity of the rolling element is achieved.

In practice, it has also proven to be advantageous that the rotatable rolling element be designed as a ball or an ellipsoid. As a result, an optimal linear and axial rolling movement of the ejection head is ensured at the sliding profile.

Furthermore, it is advantageous that the ejection head additionally comprises a spring element, via which the rotatable rolling element can be pressed against the sliding profile in the operating state. A continuous contact between the rolling element and the sliding profile is ensured by the spring element. In addition, the contact force, with which the rolling element abuts the sliding profile, can be adjusted via the spring element. Unevenness of the rolling element and/or the sliding profile can be compensated via the spring element resulting in an increased smooth running of the sealing machine.

In practice, it has also proven to be advantageous for the spring element to be designed as a spiral spring. This allows a simplified construction of the ejection head.

The present invention further relates to an ejection device for a sealing machine for sealing a container with an ejection rod and an ejection head according to the invention.

The present invention also relates to a sealing machine for sealing a container comprising an ejection device and a sliding profile, wherein the ejection device comprises an ejection rod and an ejection head and the ejection head having a sliding element, which is designed as a rotatable rolling element and via which the ejection head can be unrolled along the sliding profile in the operating state.

In an embodiment, which can be very important in practice, the sliding profile has a groove suitable for receiving and/or guiding the rotatable rolling element. As a result, the Hertzian stress between rolling element and sliding profile can be reduced. Furthermore, the rolling movement and guiding of the rolling element can be improved on the sliding profile.

It is also advantageous for the sliding profile to have a hardened surface, in particular a hard coating. As a result, the wear of the sliding profile can be reduced or the service life of the sliding profile can be extended.

Furthermore, it has proven to be advantageous, when the sliding profile is made of metal and/or plastic and/or a ceramic material and/or a composite material. As a result, the wear of the sliding profile can be reduced or the service life of the sliding profile can be extended.

Preferably, but not necessarily, the sealing machine may additionally comprise a sliding profile support with which the sliding profile is detachably connected. Thus, the sliding profile can be replaced separately at the sealing machine, which results in a cost reduction of the sealing machine.

BRIEF DESCRIPTION OF THE DRAWINGS

The invention will be explained in more detail hereinafter with reference to the drawings.

DETAILED DESCRIPTION OF THE EMBODIMENTS

Figure 1:
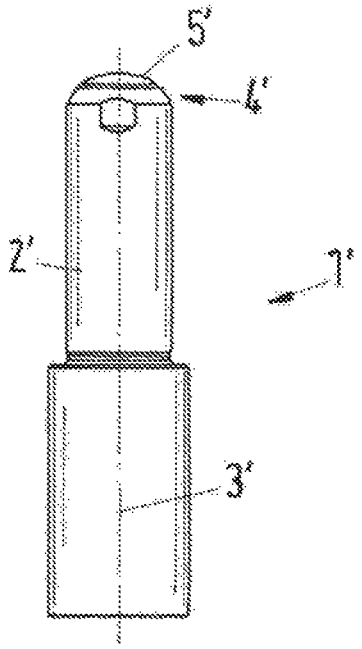
FIG. 1 is a known ejection head from the prior art.
Figure 2:
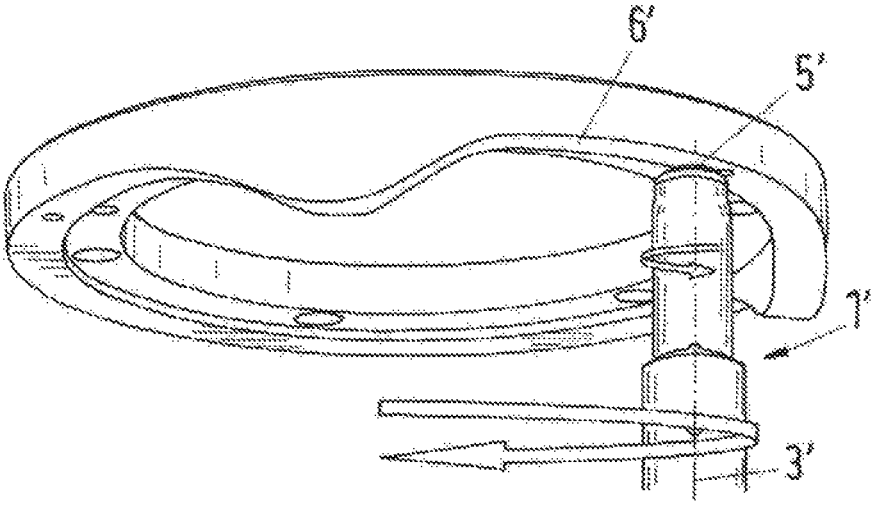
FIG. 2 is the known ejection head from FIG. 1 at a sliding profile in the operating state.

As already mentioned, FIG. 1 and FIG. 2 show the prior art and have already been explained in detail at the beginning, so that there is no need for further discussion.

Figure 3:
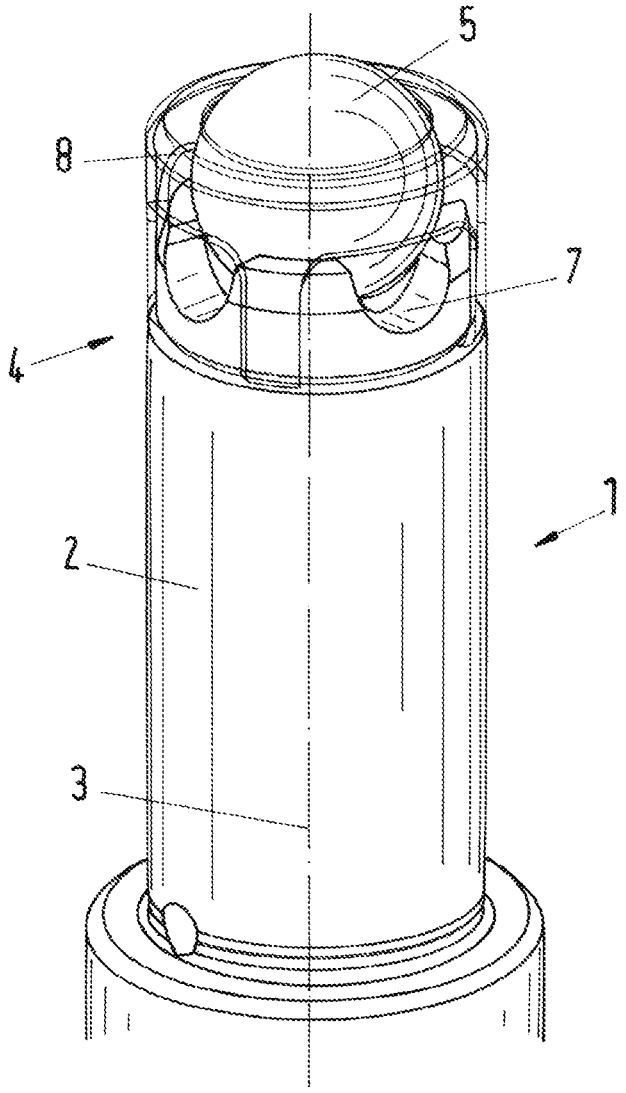
FIG. 3 is an embodiment of an ejection head according to the invention.

FIG. 3 shows a first embodiment of an ejection head according to the invention, which is referred to as a whole with the reference sign 1 in the following. The reference signs used in FIG. 3 to FIG. 6 do not have an inverted comma, since these figures relate to embodiments of the present invention. As already mentioned above, only the reference signs of FIGS. 1 and 2 have an inverted comma, since these relate to the known prior art.

According to FIG. 3, the ejection head 1 comprises a supporting element 2 with a supporting axis 3 and a sliding end 4 and a sliding element 5 for sliding the supporting element 2 along a sliding profile of the sealing machine. Thereby, the sliding element 5 is arranged at the sliding end 4 and can transmit a force acting essentially in the direction of the supporting axis 3 to the supporting element 2. The sliding element 5 is designed as a rotating rolling element in the form of a ball. The ejection head 1 additionally comprises a bearing element 7 and a holding element 8, via which the rotatable rolling element 5 is mounted or held at the supporting element 2.

Figure 4:
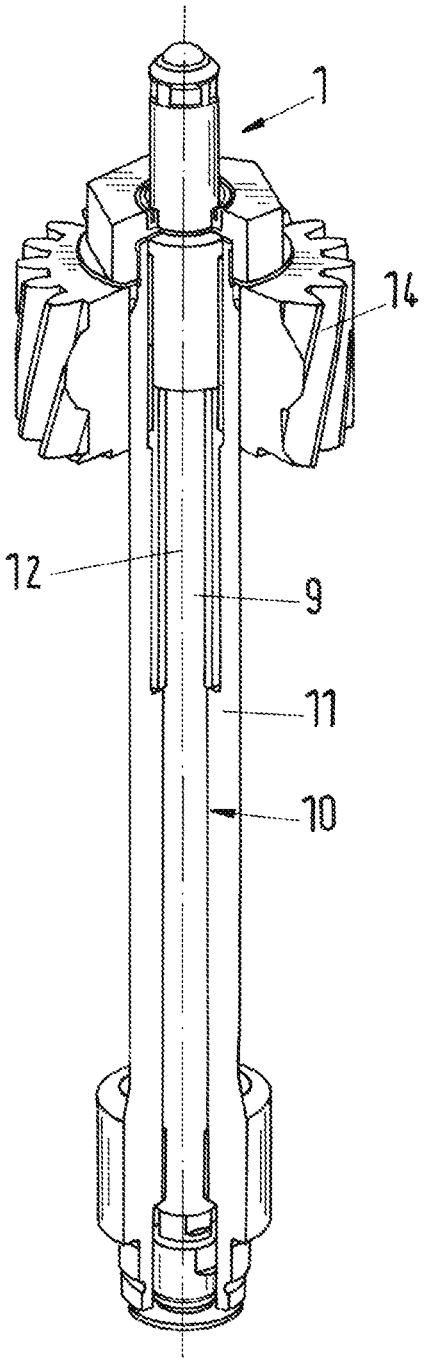
FIG. 4 is an embodiment of an ejection device according to the invention with an ejection rod and an ejection head according to FIG. 3.

FIG. 4 shows the ejection head 1 from FIG. 3 and an ejection rod 9, to which the ejection head 1 is detachably connected. Thereby, the ejection head 1 and the ejection rod 9 form a part of an ejection device 10 of a sealing machine, not shown, for sealing containers. A force can be transmitted to the ejection rod 9 via the ejection head 1 in the operating state. The ejection device 10 is movably mounted along its longitudinal axis 12 and rotatably mounted around the longitudinal axis 12 in a receiving device 11 of the sealing machine. The receiving device 11, in turn, is rotatably mounted in a holding device (not shown) of the sealing machine by receiving bearings (not shown).

A first gear ring 14 is disposed at the upper end of the receiving device 11, which gear ring interacts with a second gear ring (not shown) of the sealing machine in the operating state. The receiving device 11 and the ejection device can be set to intrinsic rotation via the first gear ring 14. The movement of the receiving device 11 and the ejection device 10 along the sliding profile 6, however, is generated via the holding device of the sealing machine.

Figure 5:
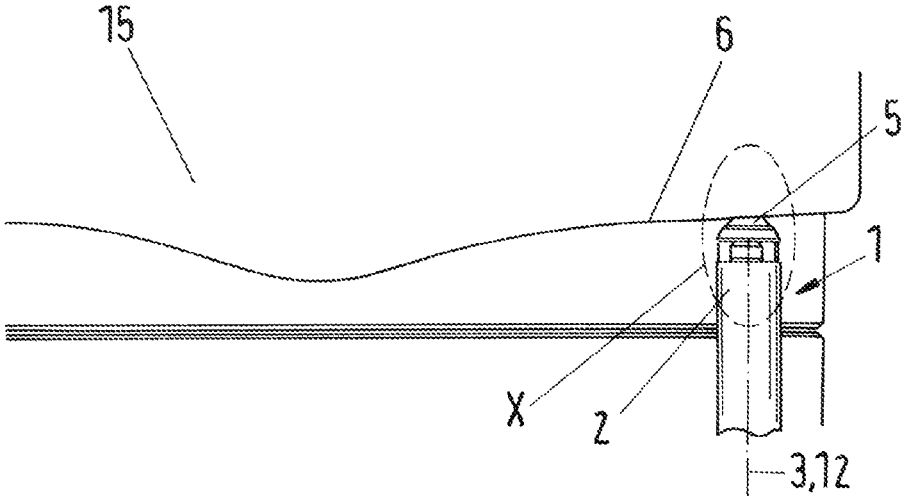
FIG. 5 is the ejection head according to the invention according to FIG. 3 at a sliding profile in the operating state.

FIG. 5 shows the ejection device 10 with the ejection head 1 according to FIG. 3 in the operating mode. In doing so, the ejection head 1 slides with the rotating rolling element 5 along the sliding profile 6 of the sealing machine, which sliding profile is connected to a sliding profile support 15 of the sealing machine. In order to achieve the two functions of holding down the container and of ejecting the container, the sliding profile 6 has two sections with an elevated level. Thereby, the one section with an elevated level of the sliding profile 6 corresponds to the function of holding down the container, in which the container to be sealed is held for the sealing operation by the ejection device and is centered for the lid sealing, and the other section with an elevated level of the sliding profile 6 corresponds to the function of ejecting the container, in which the sealed container is ejected from the sealing machine by the ejection device. During the procedure of holding down the container and of ejecting the container, the ejection head 1 is moved along the sliding profile 6 and can also rotate around the longitudinal axis 12 of the ejection device 10.

The rotating rolling element 5 performs a rolling movement at the sliding profile 6. The sliding element 5 can rotate freely relative to the supporting element 2 in order to perform the rolling movement and thereby rotate essentially around two different axes. On the one hand around the supporting axis 3. On the other hand, also around an axis which is perpendicular to the direction of movement and which varies according to the direction of movement during the movement of the rotating rolling element 5 at the sliding profile 6. This, in contrast to the prior art, where the sliding element 5' is rigidly connected to the supporting element 2' and performs a pure sliding movement at the sliding profile.

Figure 6:
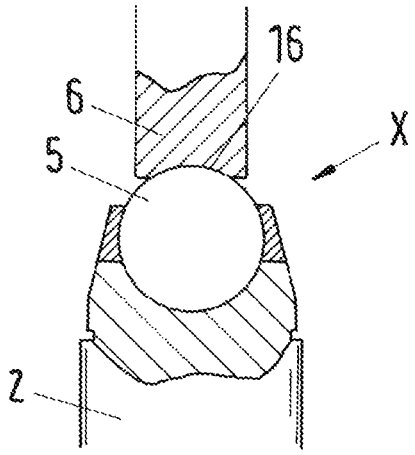
FIG. 6 is a detailed view X according to FIG. 5.

FIG. 6 shows a detailed view X according to FIG. 5. As can be seen, the sliding profile 6 has a suitable groove or a notch 16 for receiving and/or guiding the rotatable rolling element 5. Due to the groove or notch 16, the Hertzian stress between the rotating rolling element 5 and the sliding profile 6 can be reduced.

Furthermore, the rolling movement and guidance of the rotating rolling element 5 at the sliding profile 6 can be improved.

The invention claimed is:

1. An ejection head for an ejection device of a sealing machine for sealing a container, comprising:

a supporting element having a supporting axis and a sliding end; and a sliding element configured to slide the supporting element along a sliding profile of the sealing machine, the sliding element being arranged at the sliding end and configured such that a force acting essentially in a direction of the supporting axis is capable of being transmitted via the sliding element to the supporting element, the sliding element being a rotatable rolling element, so that in an operating state the supporting element is capable of being rotated relative to the rotatable rolling element along the sliding profile, the rolling element freely rotatable around the supporting axis and around an axis perpendicular to a direction of movement and which varies according to the direction of movement.

2. The ejection head according to claim 1, wherein the ejection head comprises a bearing element configured to mount the rotatable rolling element on the supporting element.

3. The ejection head according to claim 2, wherein the bearing element is detachably connected to the supporting element.

4. The ejection head according to claim 2, wherein the bearing element or the rotatable rolling element has a hardened surface.

5. The ejection head according to claim 2, wherein at least one of the bearing element and the rotatable rolling element is made of at least one of metal, plastic, a ceramic material, and a composite material.

6. The ejection head according to claim 2, wherein the ejection head comprises a holding element configured to hold the rotatable rolling element in the bearing element.

7. The ejection head according to claim 2, wherein the bearing element or the rotatable rolling element has a hard coating.

8. The ejection head according to claim 1, wherein the rotatable rolling element is a ball or an ellipsoid.

9. The ejection head according to claim 1, wherein the ejection head further comprises a first spring element configured to press the rotatable rolling element against the sliding profile in the operating state.

10. The ejection head according to claim 9, wherein the first spring element is a spiral spring.

11. An ejection device for a sealing machine for sealing a container, comprising:

an ejection rod; and an ejection head including:

a supporting element having a supporting axis and a sliding end, and a sliding element configured to slide the supporting element along a sliding profile of the sealing machine, the sliding element being arranged at the sliding end and configured such that a force acting essentially in a direction of the supporting axis is capable of being transmitted via the sliding element to the supporting element, the sliding element being a rotatable rolling element, so that in an operating state the supporting element is capable of being rotated relative to the rotatable rolling element along the sliding profile, the rolling element freely rotatable around the supporting axis and around an axis perpendicular to a direction of movement and which varies according to the direction of movement.

12. A sealing machine for sealing a container, comprising:

an ejection device including:

an ejection rod; and an ejection head including:

a supporting element having a supporting axis and a sliding end, and a sliding element configured to slide the supporting element along a sliding profile of the sealing machine, the sliding element being arranged at the sliding end and configured such that a force acting essentially in a direction of the supporting axis is capable of being transmitted via the sliding element to the supporting element, the sliding element being a rotatable rolling element, so that in an operating state the supporting element is capable of being rotated relative to the rotatable rolling element along the sliding profile, the rolling element freely rotatable around the supporting axis and around an axis perpendicular to a direction of movement and which varies according to the direction of movement; and a sliding profile, the sliding element being a rotatable rolling element configured to unroll the ejection head along the sliding profile in the operating state.

13. The sealing machine according to claim 12, wherein the sliding profile has a groove configured to receive or guide the rotatable rolling element.

14. The sealing machine according to claim 12, wherein the sliding profile has a hardened surface.

15. The sealing machine according to claim 12, wherein the sliding profile is made of at least one of metal, plastic, a ceramic material, and a composite material.

16. The sealing machine according to claim 12, further comprising a sliding profile support, and the sliding profile being detachably connected to the sliding profile support.

17. The sealing machine according to claim 12, wherein the sliding profile has a hard coating.

* * * * *